United States Patent [19]

Riegelman

[11] Patent Number: 4,873,741

[45] Date of Patent: Oct. 17, 1989

[54] SLIDING DOOR ROLLER APPARATUS

[75] Inventor: Harry Riegelman, Lewisburg, W. Va.

[73] Assignee: Columbia Manufacturing Corporation, Gardena, Calif.

[21] Appl. No.: 32,744

[22] Filed: Mar. 31, 1987

[51] Int. Cl.[4] ..... E05D 13/02

[52] U.S. Cl. ..... 16/105; 16/97; 49/425

[58] Field of Search ..... 16/97, 98, 99, 100, 16/105, 91; 49/425, 420

[56] References Cited

U.S. PATENT DOCUMENTS

| | | | |
|---|---|---|---|
| 3,716,890 | 2/1973 | Benson | 16/105 X |
| 4,006,513 | 2/1977 | Offterdinger | 16/105 X |
| 4,030,160 | 6/1977 | Lambertz et al. | 16/105 |
| 4,112,622 | 9/1978 | Stewart | 16/97 X |

*Primary Examiner*—Nicholas P. Godici

*Assistant Examiner*—Carmine Cuda

*Attorney, Agent, or Firm*—Charles H. Thomas

[57] ABSTRACT

A sliding door roller apparatus includes a replaceable wheel assembly that can be easily removed and replaced on a holding member. The wheel assembly includes a resilient housing, a wheel, and an axle on which the wheel turns. The resilient housing has a pair of opposite facing sidewalls, each having an integral end portion that extends toward and overlaps the other. Each end portion includes at least one locking finger that is positionable within an opening on the holding member. The resiliency of the housing permits the locking fingers to be placed or removed from an opening located on the holding member.

The apparatus also includes an adjustment mechanism that positions the wheel assembly outside the sliding door frame to permit the frame to be properly aligned within its door opening.

16 Claims, 3 Drawing Sheets

FIG-1
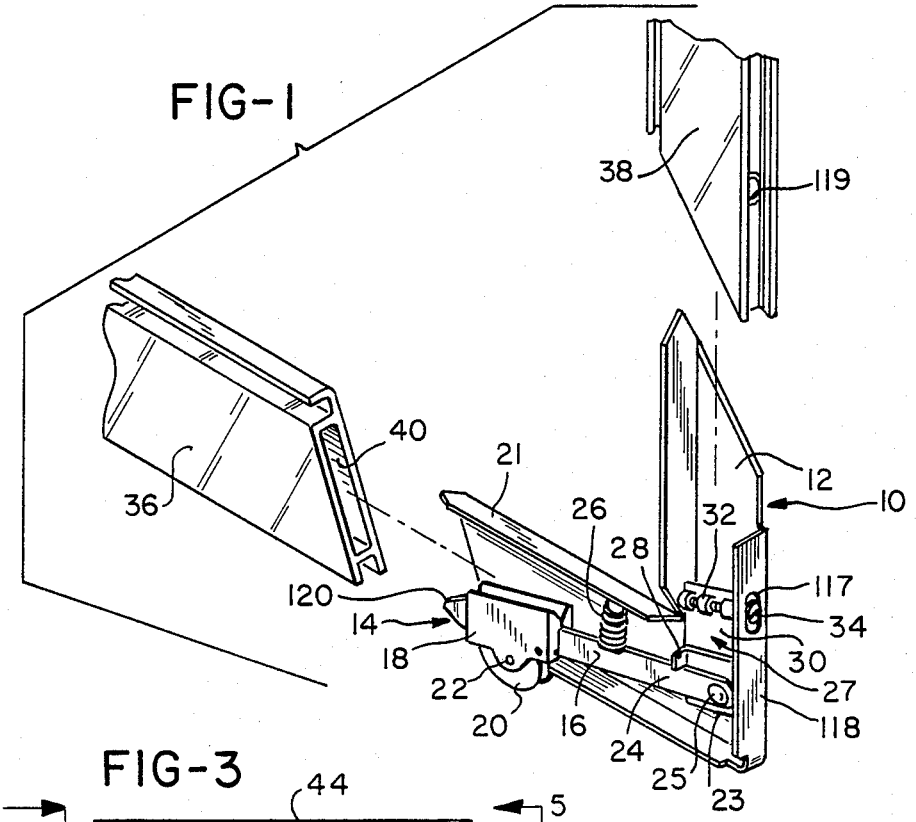
FIG-3
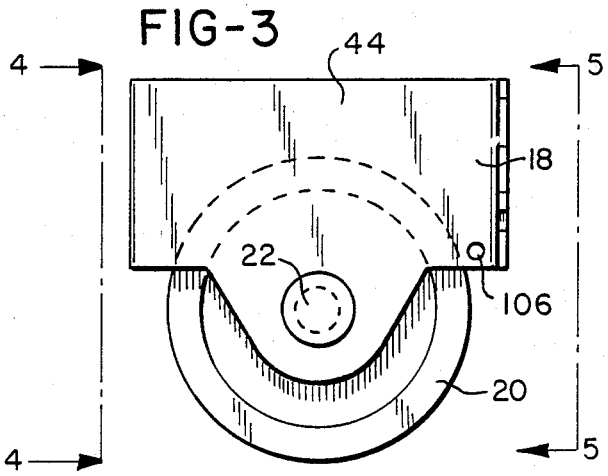
FIG-2
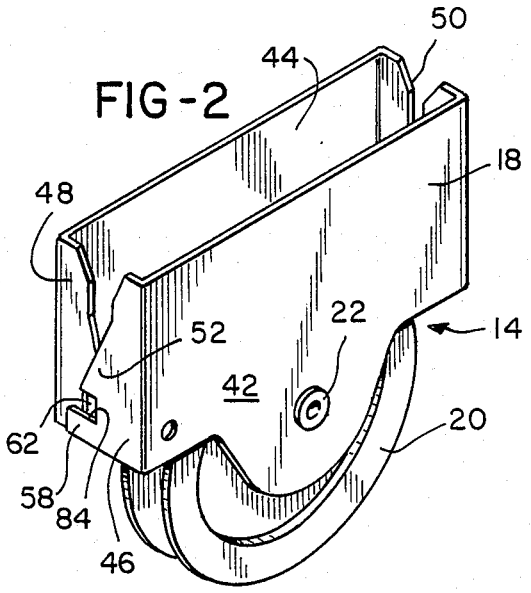
FIG-4
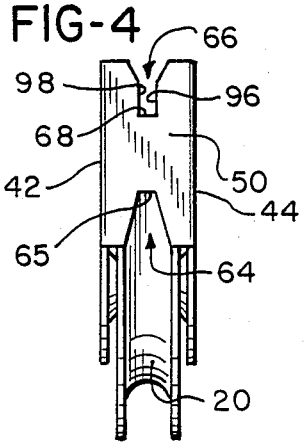
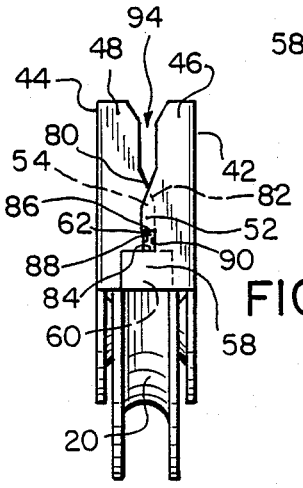
FIG-5

SLIDING DOOR ROLLER APPARATUS

BACKGROUND OF THE INVENTION

1. Field of the Invention

The present invention elates generally to sliding doors and more particularly to a novel, sliding door roller apparatus having an improved, replaceable wheel assembly that can be easily removed and replaced with a new wheel assembly whenever a wheel breaks or wears out. The present invention eliminates the need to disassemble or reassemble the outer door frame while replacing the broken or worn out wheel. The present invention also includes an advantageous adjusting mechanism for positioning the wheel assembly within the door frame to allow the sliding door to be properly positioned within its door opening.

2. Description of the Prior Art

A sliding door is a well-known device in the art that generally includes an outer frame having top and bottom rollers or wheels that engage upper and lower tracks located in a door opening that guide the door's horizontal movement. The outer frame is generally constructed from roll-formed or extruded tubular shaped rails (the horizontal portion of the frame) and stiles (the vertical portion of the frame). The ends of the rails and stiles are usually mitered at 45° angles and are press fitted onto corner brackets to form the four corner joints of the outer frame. After the rails and stiles have been joined, wire screening or glass can be placed within recessess located on the frame to form the sliding door.

Generally, a screen door is manufactured with its wheel or roller assemblies mounted within the top and bottom rails of the outer frame. Preferably, the wheel assemblies are mounted on the corner brackets that help form the corner joints since these brackets are usually made from steel and are much stronger than the rail portions that are usually made from lighter-weight material, such as aluminum. The wheels of the assemblies extend through openings formed in the rails for engagement with the upper and lower tracks.

Probably the most common problem associated with prior art sliding doors has been the breaking or wearing out of the wheels during usage. In order for a sliding door to properly move along its tracks, the wheels must be in good working condition. Therefore, even if a single wheel is broken, the other wheels usually cannot compensate for the broken wheel to maintain the continuous smooth sliding motion of the door on its tracks. Therefore, whenever a wheel breaks or wears out, it must be immediately replaced with a new wheel.

The replacement of a wheel on a prior art sliding door can be a very difficult job, especially if the sliding door has its wheel assemblies mounted on the corner brackets of the frame. Whenever a wheel breaks or wears out on such a unit, the outer frame usually has to be disassembled to reach and replace the broken wheel. If the sliding door is a screen door, the screening usually has to be at least partially removed from the frame before the frame can be disassembled. While the removal of the screening is usually an easy job, its later replacement back onto the frame can be very difficult.

Once the screening has been remove, the rails and stiles have to be disassembled to reach and remove the broken wheel. Usually, the wheel itself is not replaced, but rather, the entire wheel assembly that holds the wheel is removed and replaced with a new unit. One problem that can be encountered in replacing the wheel assembly is that replacement units are not always readily available in retail stores. Therefore, the door manufacturer may have to be contacted to obtain a properly fitting wheel assembly.

After the broken wheel or wheel assembly has been replaced, the stiles and rails have to be remounted on the corner bracket and the screening has to be placed back on the frame. If the screen door was originally made with machinery that stretched and attached the screening to the frame, the screening might not properly fit back onto the frame. If this occurs, the screening usually has to be stretched by hand to fit back into the recesses on the frame. However, it is possible that this stretching could cause distortion or create holes in the screening. Therefore, even if the screening could be replaced back onto the frame, it could lose its original appearance and shape.

As a result of the difficulty in replacing the wheels on prior art screen doors, most homeowners would rather continue using the screen door with the broken wheel than fix it. However, a broken wheel, especially a broken, bottom wheel, results in a sliding door that does not move very smoothly along its tracks. Also, the continued use of a door with a broken wheel can cause the other wheels to break prematurely or wear out faster than normal. Another possible alternative for the homeowner with a broken wheel is to replace the entire screen door with a new door, rather than fix the broken wheel. This is an often used alternative especially if the prior art screen door is a cheaply made product having a relatively low retail cost.

One prior art device described in U.S. Pat. No. 3,716,890 allows for the replacement of a broken wheel on sliding doors without the necessity to disassemble and reassemble the outer frame. However, this device requires the removal and replacement of a rivet that holds the wheel to its housing while the housing remains on the door frame. This manual replacement of the rivet is not only awkward but may require the need for a special rivet gun or other tool to properly fasten the wheel back to its housing. Even if an alternate fastener such as a nut and bolt is used, the nut can become loose during usage which can cause the wheel to become detached from its housing.

Another frequently encountered problem associated with a sliding door, especially a screen door, is partly attributed to its relatively low weight. Since a screen door seldom exceeds 10 pounds in weight, it has a tendency to jump from its tracks and jam, thus interfering with the smooth opening and closing of the screen door. This jumping problem is especially prevalent if either, or both, of the upper or lower tracks are bowed. When a track becomes bowed, there is a location along the tracks where the tracks are further apart than normal. If the tracks are far enough apart from each other, a space is created between the tracks which can cause a wheel to leave its track. This jumping problem especially occurs if one pushes or pulls on the light-weight door while sliding it across its tracks. When a wheel does leave its track, it must be immediately positioned back on its track to allow the door to slide smoothly again. The placement of the wheel back on its track is not always an easy task and can be quite frustrating to a home owner, especially if the wheel continually jumps from its track.

Various types of rollers or wheel assemblies have been suggested to maintain the wheels in proper contact with the tracks to avoid this jumping problem. On some prior art screen doors, the wheels can be moved outward from the frame to somewhat compensate for a bowed track. However, if the top and bottom wheels extend too far from the frame, there is a possibility that the sliding screen door could jam at locations where the top and bottom tracks are at their narrowest distance from each other. Either the top or bottom wheel would then have to be moved back into the frame. Therefore, it is not possible to alleviate the jumping problem by merely setting the top and bottom wheels at their maximum outward positions.

Other prior art devices alleviate this jumping problem by biasing the wheel assembly outward from the frame. The biasing means, typically a spring, maintains the wheel assembly outward from its frame so that the wheels remain in proper contact with its track. Whenever the wheels encounter a bowed portion along the tracks, the wheels move out to compensate for the widened opening between the tracks. Alternatively, whenever the frame encounters a narrow spot along the track, the wheels are pushed back inwards into the frame to compensate for the narrow alignment.

One problem associated with such spring biased roller assemblies is that the bottom supporting roller assemblies support the weight of the sliding door. The weight of the sliding door can cause the bottom wheels to move back to the farthest position within the door frame, especially if the force of the spring is not very large. If the wheels retract back into the door frame, it is possible that the bottom edge of the sliding door can contact the bottom surface of the door frame, thus interfering with the smooth sliding motion of the door. Therefore, although these prior art devices somewhat alleviate the jumping problem, they still lack some means to position the wheels and still properly support the door.

This problem of properly positioning the wheels within the frame of the sliding door is further increased if the bottom wheels are also used to position the side stiles of the sliding door with the side jambs of the door opening. Usually, a door opening is not always perfectly rectangular or the bottom or lower tracks will become warped or bowed from use. As a result, the screen door, which is capable of being manufactured with more precision, may be crooked or misaligned when placed in the door opening. When this occurs, the side stiles of the sliding door do not properly align with the side door jambs of the door opening. Even a slight misalignment of the screen door against the door jambs can create an opening large enough for insects to pass through. Thus, the purpose behind the use of a screen door is defeated, if insects, such as mosquitoes, fleas and bees, can easily pass through openings caused by an improperly aligned screen door.

The simple solution of this problem is to properly align the stiles of the sliding door with the door jambs. One way of doing this is to tilt one side of the screen door until proper vertical alignment is made with the door jamb. This alignment can be accomplished by raising or lowering one or both of the bottom wheels of the screen door. The raising or lowering of the bottom wheel is accomplished by either extending or retracting the wheel from its opening in the rail portion of the frame while the weight of the sliding door is borne by the wheel. This operation is referred to as adjusting the "height" of the wheel. The mechanism that sets the "height" of the wheels must be easily accessible to the user to permit the door to be properly positioned within the door opening.

The present invention has as its objective the elimination of the above-mentioned and additional disadvantages associate with conventional sliding door wheel or roller assemblies The present invention provides a sliding door roller apparatus with an advantageous replaceable wheel assembly that can be easily removed and replaced with a new wheel assembly without the need to disassemble and reassemble the frame of the screen door. This is a major advantage over prior art devices since one can now easily replace a broken or worn out wheel, thus increasing the useful life of the sliding door.

The present invention merely requires the user to remove the screen door from its tracks and use a small tool to pop out the wheel assembly from its holding member located on the corner mounting bracket of the frame. Once the wheel assembly is removed, a new wheel assembly can be easily snapped back onto the door by merely pushing the wheel assembly back onto its holding member. The screen door can be reset back on its tracks and the screen door will again move smoothly along its tracks.

The invention also includes a mechanism mounted to the mounting bracket that can set the "height" of the bottom wheels to properly align the stiles of the screen door with the jambs of the door opening. This adjustment mechanism allows the screen door to be properly installed within the door opening and provides an outward biasing force on the wheels to prevent the wheels from jumping from a bowed track. As a result, the sliding door remains in proper orientation with the door jambs of the door opening and moves smoothly within its tracks.

SUMMARY OF THE INVENTION

The present invention provides a novel, adjustable roller apparatus with an improved wheel assembly for sliding doors. The present invention includes a mounting bracket and a wheel assembly that is removably mounted to the bracket. In a preferred form or embodiment, the wheel assembly includes a wheel, an axle, and a resilient wheel housing. The wheel housing is usually mounted on a holding member that can also be movably mounted onto the mounting bracket A resilient housing that is capable of being placed in a locked and unlocked position is used to facilitate the easy placement and removal of the wheel assembly onto its holding member.

In a preferred embodiment, the wheel housing has two opposite, resilient side walls each having an integral end portion extending towards and overlapping each other. Each end portion usually has at least one locking finger that overlaps the other locking finger. These locking fingers can be placed in an opening located on the holding member. Due to the resiliency of the two opposing side walls, the locking fingers usually remain in the locked position. However, by imparting an outward, opposite force on the side walls, one can separate the locking fingers so that they do not overlap each other to permit the fingers to be removed from or placed within the opening located on the holding member.

Each locking finger may also include means for moving the end portions to separate the locking fingers from their overlapping position. In the preferred embodiment, this moving means takes the form of a guiding surface that is integral with each locking finger and is adapted for sliding engagement with a portion of the holding member. In operation, as the wheel assembly is snapped onto its holding member, a bridge portion located on the holding member slides along the guiding surfaces of the locking fingers to spread the locking fingers apart. After the locking fingers move past this bridge portion, the fingers encounter the opening on the holding member that helps keep the wheel housing firmly locked in place. Once the locking fingers reach the opening, the resiliency of the side walls causes the fingers to move back into their overlapping, locking position. These locking fingers remain within the opening until the wheel assembly is desired to be removed by the user.

In removing the wheel assembly, the user merely places a special tool into holes located in each of the two opposing side walls of the wheel housing. The tool is designed to impart an outward force on the sidewalls by simply squeezing the handle of the tool. When the handles are squeezed, the side walls and end portions will moveaway from each other, thus moving the locking fingers from their overlapping position. Once the locking fingers are placed in this unlocked position, the wheel assembly can be easily removed from its holding member.

The apparatus also includes means, referred to as "adjusting means", for adjusting the position of the wheel assembly on the mounting bracket. In a preferred embodiment, the holding member may take the form of a pivot arm having one end pivotally connected to the mounting bracket. The wheel assembly is attached to this pivot arm and extends through an opening in the rail portion of the frame.

The adjusting means include means referred to as abutting means" for abutting against this pivot arm and "moving means" for moving the abutting means on the mounting bracket.

In a preferred form, the moving means can take the form of a limit member that is pivotally connected to the mounting bracket. The abutting means may take the form of a projection formed on this limit member that abuts at least a portion of the pivot arm.

In operation, the weight of the sliding door causes the pivot arm to move upward to abut against the projection on the limit member. This limit member includes a sleeve that receives a screw or bolt that in turn abuts against a portion of the mounting bracket, preventing any further upward movement of the pivot arm or projection. The screw is accessible to the user through a small hole located in the stile portion of the door frame. By adjusting the relative position of the screw within the sleeve, one can change the vertical position of the projection on the mounting bracket. By moving the projection to different vertical positions on the mounting bracket, one can set the pivot arm to stop at different positions on the bracket, allowing the wheel assembly to be positioned at different extended positions from the frame. One can thus change the "height" of the wheel by merely setting the screw to a desired position within its sleeve.

The present invention thus provides a novel, sliding door roller apparatus with a replaceable wheel housing that can be easily removed and replaced with a new wheel housing whenever a wheel breaks or wears out from use. An object of the present invention is to provide a replaceable wheel assembly that can be removed and replaced without the need to disassemble and reassemble the outer door frame. Also, an advantage gained in using the resilient wheel housing in accordance with the present invention is that there is no need for special fasteners or special fastening tools to place a new wheel on the sliding door. Also, an added feature of the present invention is that the person replacing the wheel assembly needs no special mechanical skills to remove or replace the resilient wheel housing. One need only insert a tool which imparts an outward force on the side walls of the housing to remove the wheel assembly from its holding member mounted within the door frame. The replacement of the wheel assembly is accomplished by merely aligning the wheel assembly within its holding member and snapping it into place.

The present invention not only saves time and expense, but provides for an easy mechanism that a homeowner can remove and replace himself at a relatively low cost. The adjustment mechanism of the present invention is also novel since it provides a simple and easy-to-use device for adjusting the wheel assembly within the frame to permit the door to be properly aligned within its door opening. Also, the wheel assembly helps maintain the wheel within its track and compensates for any bowing of the track caused by warpage or an improperly cut door opening.

BRIEF DESCRIPTION OF THE DRAWINGS

A complete understanding of the present invention and other advantages and features thereof may be gained from a consideration of the following preferred embodiment taken in conjunction with the accompanying drawings in which:

FIG. 1 is a perspective view of a preferred embodiment of the present invention showing rail and stile portions that form one of the corners of the frame of the sliding door.

FIG. 2 is a perspective view of a preferred form of the wheel assembly.

FIG. 3 is a side view of the wheel assembly shown in FIG. 2.

FIG. 4 is an end elevational view showing the connecting wall of the wheel assembly shown in FIG. 2 as viewed from line 4—4 of FIG. 3.

FIG. 5 is an end elevational view of the wheel assembly shown in FIG. 2 as viewed from line 5—5 of FIG. 3.

DETAILED DESCRIPTION OF THE PREFERRED EMBODIMENTS

Figure 6:
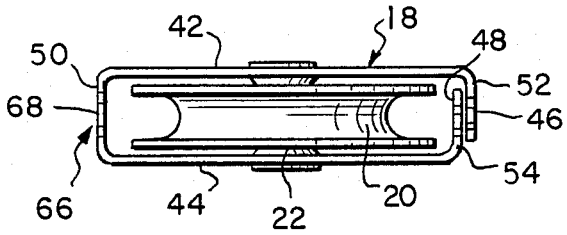
FIG. 6 is a top view of the wheel assembly shown in FIG. 2.

While the present invention is susceptible of various modifications and alternative constructions, the embodiment shown in the drawing will herein be described in detail. It should be understood, however, that it is not the intention to limit the invention to the particular form disclosed; but, on the contrary, the intention is to cover all modifications, equivalents and alternative constructions falling within the spirit and scope of the invention as expressed in the appended claims.

Referring initially to FIG. 1, a sliding door roller apparatus 10 built in accordance with the present invention is shown. The roller apparatus includes a mounting bracket 12 upon which a wheel assembly 14 is attached. The wheel assembly 14 is removably mounted onto a holding member 16 that is also attached to the mounting bracket 12. The wheel assembly 14 includes a wheel housing 18, a wheel 20 that rolls along a track (not shown) and an axle 22 on which the wheel 20 turns.

In the preferred form of the invention, the holding member 16 takes the form of a pivot arm 24 that has one end 23 pivotally attached to the mounting bracket 12 via a rivet 25. A biasing means, such as a spring 26, is attached to a flange 21 of the mounting bracket and the pivot arm 24 to impart an outward force that helps keep the wheel assembly 14 extended away from the mounting bracket flange. An adjustment mechanism 27 for adjusting the position of the wheel assembly within the rail includes abutting means shown as an abutting projection 28 and moving means shown as a limit member 30 that is also pivotally attached to the mounting bracket via the rivet 25. The projection 28 is merely an integral flange-type projection that is formed on the limit member to abut against the pivot arm. The limit member 30 also includes a sleeve 32 that receives a screw 34 that helps position the limit member 30 and the abutting projection on the mounting bracket. This adjustment mechanism 27 will be described in greater detail below.

FIG. 1 also shows a rail portion 36 and a stile portion 38 that forms part of the outer frame of the screen door. Both the rail portion 36 and stile portion 38 are mitered at a 45° angle to form one of the corner joints of the sliding door. The mounting bracket is designed to fit snugly within the recess 40 (shown only on the rail portion) of the rail 36 and stile 38. While FIG. 1 shows only one corner of the sliding door, there are three additional corner joints each having a similar roller apparatus and mounting bracket. The wheel assembly passes through an opening located in the rail portion 38 (see FIG. 10) to allow the wheel to come in contact with its track (not shown). The other three roller apparatus are also placed to allow the wheel assemblies to extend through additional openings in the top and bottom rail portions. In a conventional sliding door, there are usually two bottom wheel assemblies and two upper wheel assemblies. This number of wheels permits the sliding door to slide smoothly along its upper and lower tracks.

The relatively inexpensive and simple construction of the wheel assembly can be seen by referring now to FIGS. 2 through 6. Referring specifically to FIG. 2, the mounting bracket with its resilient wheel housing 18 is shown along with the wheel 20 and axle 22 which also form the assembly. The wheel housing 18 includes a first resilient side wall 42 and a second resilient side wall 44. These two side walls are opposite from each other and have the wheel placed between them. The wheel is attached to these two side walls 42 and 44 via the axle 22 which may simply be a rivet that prevents the wheel from coming unattached from the housing. Each of these two opposing side walls 42 and 44 have integral end portions 46 and 48 extending towards and overlapping each other. The top view of the wheel assembly shown in FIG. 6 shows how these two end portions 46 and 48 overlap each other. Also, a connecting wall 50 integral with the two side walls 42 and 44 is disposed between these two side walls. This connecting wall contains several slots (described below) which help maintain the wheel assembly on its holding member.

Referring now to FIG. 5, the end portions 46 and 48 are shown in greater detail. The first end portion 46 includes a first locking finger 52 that extends and overlaps a similar first locking finger 54 formed on the second end portion 48. These two first locking fingers 52 and 54 are placed within the opening 56 on the holding member 16 shown in FIG. 7. When these locking fingers 52 and 54 overlap each other, the wheel assembly is defined as being in its locked position. When these same two locking fingers 52 and 54 are spread apart from each other so that they are n longer overlapping, the wheel assembly is defined as being in its unlocked position.

A second locking finger 58 (FIGS. 2 and 5) located directly below the first locking finger 52 of end portion 46 is also included. Similarly, a second locking finger 60 is located directly below the first locking finger 54 of end portion 48. Each of these first and second locking fingers are spaced apart to form and define a notch between the two fingers. The first and second locking fingers of each end portion collectively cooperate to form a receiving opening 62 that is used to help retain the wheel housing on its holding member. This receiving opening 62, along with the first and second fingers of the end portions, help maintain the wheel assembly on the holding member and also provide lateral support to the wheel assembly when it is on the holding member.

Referring now to FIG. 4, the connecting wall 50 is shown in greater detail. The connecting wall is generally perpendicular to the two opposing side walls 42 and 44 and is generally slightly larger than the width of the wheel 20. The connecting wall includes a first slot 64 having a bottom abutting surface 65. This first slot 64 is placed in contact with a projection 76, FIG. 7 (described below) that is located on the holding member. The connecting wall also includes an abutting slot 66 having a top abutting surface 68 that also comes in contact with the holding member (described below). Both of these two slots are cut in a substantially V-shape configuration to help guide the wheel assembly onto the holding member when the user snaps the assembly into place.

Figure 7:
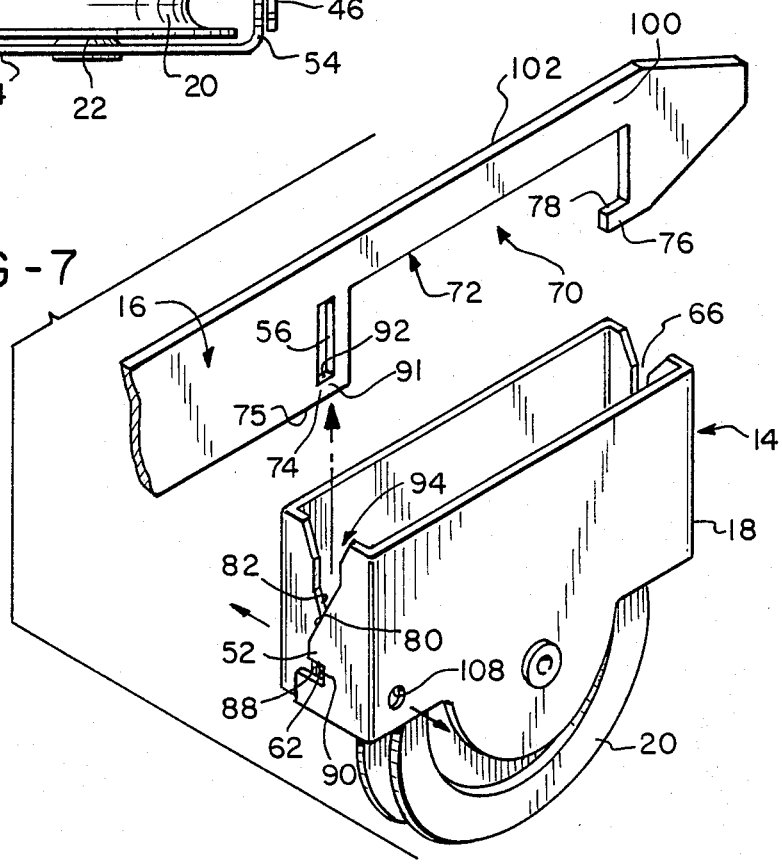
FIG. 7 is a perspective view showing the wheel assembly and its holding member.

Referring now to FIG. 7, the holding member 16 is shown in greater detail. In the preferred embodiment, the holding member 16 can take the form of the pivot arm 24 depicted in FIGS. 1, 8 and 9. However, the holding member 16 can take on any shape or size that permits the wheel assembly to be properly mounted on it.

The holding member 16 includes an opening 56 which, as mentioned above, receives the first locking fingers 52 and 54. The holding member includes a recess 70 having a length substantially the length of the wheel assembly. This recess 70 defines a restraining surface 72 (shown better in FIG. 10) that is used to restrain the upward movement of the wheel assembly once the assembly has been placed on the holding member. A bridge portion 74 that is merely a thin piece of material located directly beneath the opening 56 is also included.

This bridge portion 74 is designed to fit within the receiving opening 62 formed by the first and second locking fingers on the end portions once the assembly has been placed on the holding member. The bridge member also includes an abutting projection 76 extending near the bottom edge of the holding member and inward into the recess 70. This abutting projection 76 comes in contact with the abutting surface 65 located on the first slot 64 on the connecting wall.

In operation, the wheel assembly is placed on the holding member by first placing the first slot 64 over the abutting projection 76 located on the holding member. The abutting surface 65 is allowed to come in contact with a top surface 78 on the abutting projection 76 and remains in contact to help prevent the wheel assembly from moving downward once it is placed on the holding member. Then, the wheel assembly is pivoted upwards using the abutment of surfaces 65 and 78 as a fulcrum so that the end portions 46 and 48 straddle the bridge portion 74 on the holding member. It should be noted that the wheel assembly also includes means for imparting an outward force on each of the end portions to place the wheel housing in its unlocked position. In FIG. 7, this force imparting means is shown as a guiding surface 80 located on the first locking fingers 52. Similarly, another guiding surface 82 is located on the other first locking finger 54. (See also FIG. 5) These guiding surfaces 80 and 82 come in contact with a bottom surface 75 (FIG. 10) of the bridge portion 74 as the wheel assembly is moved upwards onto the holding member. As the wheel assembly is pushed upwards along the bridge portion, the bridge portion slides along the guiding surfaces 80 and 82 to separate the first locking fingers 52 and 54. (See FIG. *7a*) At a certain point, the first locking fingers will no longer be overlapping each other and will be separated by the bridge portion 74. As the assembly continues upward, the first locking fingers will encounter the opening 56 on the holding member. Once the locking fingers reach the opening, the resiliency of the housing forces the locking fingers back into their overlapping or locked position. In this fashion, the locking fingers prevent the wheel assembly from being removed from the holding member until an outward force is imparted on the side walls to separate the first locking fingers.

During the process of placing the first locking fingers within the opening on the holding member, the bridge portion 74 is also placed within the receiving opening 62 defined between the first and second locking fingers on each end portion. The second locking fingers 58 and 60 on each end portion help prevent any further upward movement of the wheel assembly once placed on the holding member. Referring back to FIG. 5, the receiving opening 62 includes bottom abutting surfaces 84 located on each of the second locking finger 58 and 60. These bottom abutting surfaces 84 come in contact with the bottom surface 75 located on the bridge portion 74. The receiving opening 62 also includes top abutting surface 86 formed directly below the first locking fingers on each end portion which contacts a top surface 92 (FIG. 7) located on the bridge portion. These bottom and top abutting surfaces 84 and 86 help prevent the wheel assembly from moving upwardly or downwardly once the wheel assembly has been snapped into place. The receiving opening also includes two side abutting surfaces 88 and 90 that contact side walls 91 and 93 (FIG. 10) of the bridge portion to provide lateral support to the wheel assembly. These side walls contact each other to help prevent the wheel assembly from moving laterally on the holding member once the wheel assembly has been snapped into place.

The end portions 46 and 48 (FIGS. 5 and 7) of the wheel housing also define a retaining slot 94 located near the top part of the housing. This retaining slot 94, along with the abutting slot 66 (FIG. 4) on the connecting wall, are placed up along the restraining surface 72 of the holding member. The abutting surface 68 of the abutting slot 66 is placed in direct contact with the restraining surface 72 to prevent upward movement of the wheel assembly during use. Also, the abutting slot 66 includes a pair of stabilizing side walls 96 and 98 which straddle the side walls 100 and 102 of the holding member (see FIGS. 5, 7 and 10). These stabilizing side walls 96 and 98 provide sufficient stability to also help keep the wheel housing from moving laterally during use. Also, the retaining slot 94 helps provide lateral stability to the assembly.

Figure 10:
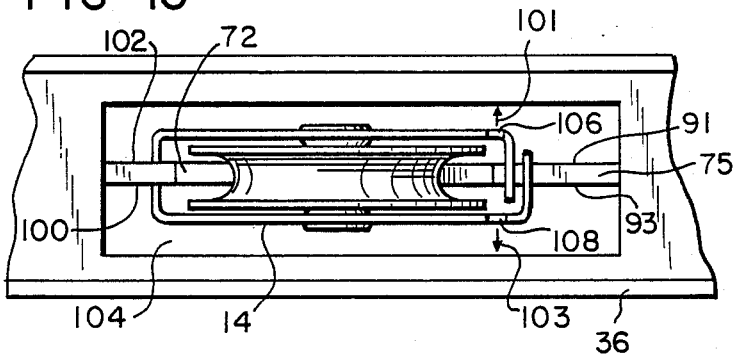
FIG. 10 is a bottom plan view showing the wheel assembly as it is positioned within a rail section of the frame.
Figure 7A:
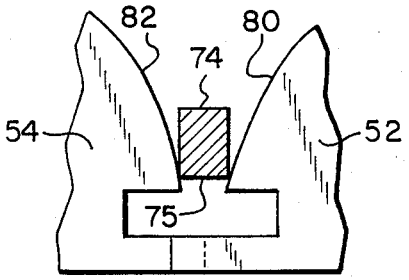
FIG. 7*a* is an elevational view showing insertion of the wheel assembly.
Figure 11:
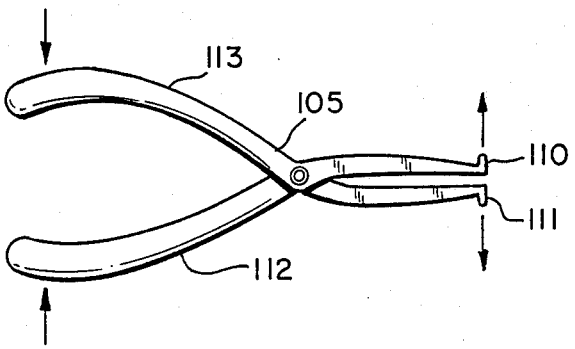
FIG. 11 is a plan view of a tool used to remove the wheel assembly from its holder member.

A wheel assembly positioned on the holding member 16 and extending through an opening 104 in the rail portion 36 is shown in FIG. 10. The wheel assembly remains on the holding member until the user is ready to remove it due to a broken or worn out wheel. In order to remove the wheel assembly from the holding member, one must apply an opposing force in the direction of arrows 101 and 103 (FIG. 10) to the side walls of the housing. A simple and inexpensive tool 105 which imparts the required force on the side walls is shown in FIG. 11. Each side wall has a hole 106 and 108 located near the end portion of the housing that receive tips 110 and 111, respectively of the tool 105. Once the tips have been placed into the holes, handles 112 and 113 can be squeezed toward each other to produce a spreading of the tips and thus an outward force on the side walls. Once the first locking fingers have been spread enough from each other that they no longer overlap, the wheel assembly can be simply pulled away from the holding member by the tool to remove the wheel assembly from the holding member. A replacement wheel assembly can be easily snapped into place utilizing the placement procedure described above.

Figure 8:
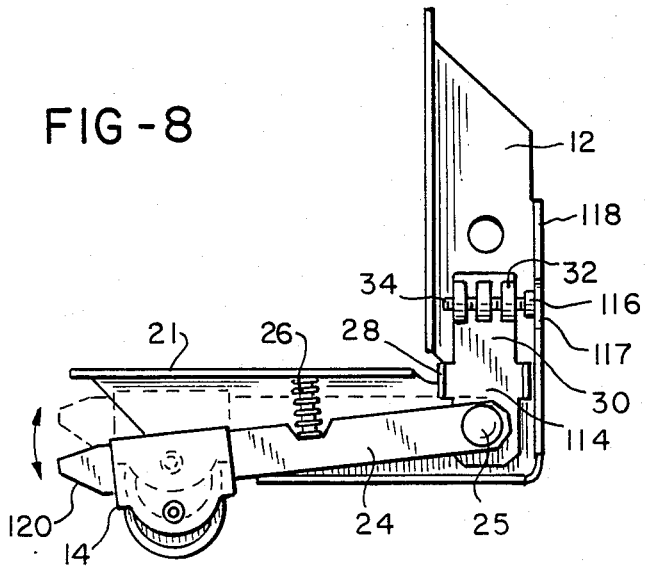
FIG. 8 is a side view showing the wheel assembly mounted to a pivot arm in its fully extended position.
Figure 9:
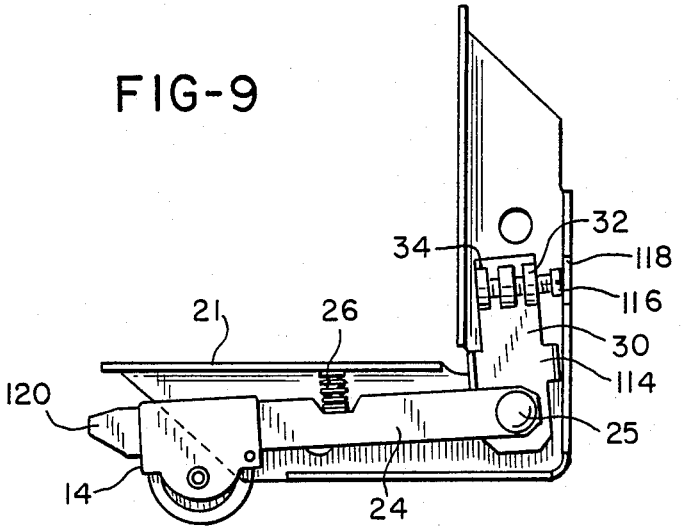
FIG. 9 is a side view showing the pivot arm abutted against a projection on the pivot plate.

The adjusting mechanism 27 on the present invention is now explained in greater detail. Referring now to FIGS. 1, 8 and 9, the adjustment mechanism is comprised of the pivot arm 24 that is pivotally attached to the mounting bracket. The abutting projection 28 on the limit member 30 comes in contact with the pivot arm to prevent its upward movement. In operation, the weight of the screen door causes the bottom wheel to retract upwardly into the rail portion until the top of the pivot arm strikes either the flange 21 of the mounting bracket or the abutting projection 28. By moving the abutting projection to a desired position, one can move the wheel assembly outward from the rail while still supporting the weight of the screen door.

In the preferred form of the invention, the abutting projection 28 is moved along the mounting bracket by utilizing the limit member 30 which comprises a pivot plate 114 that is pivotally fixed to the mounting bracket. This pivot plate 114 has the sleeve 32 integrally formed therein that is adapted to receive the screw 34. Referring specifically now FIGS. 8 and 9 for clarity, the screw is positionable within the sleeve so that a top head 116 of the screw comes into contact with a side flange 118 of the mounting bracket. The head 116 of the screw is accessible to a user through a slot 117 formed in the side flange 118 (See FIG. 1) and a similar slot 119 formed in the side of the stile portion of the outer frame (see FIG. 1). The screw can be positioned by inserting a screwdriver into these two slots and turning the screw to the desired position within the sleeve.

In FIG. 8, the screw is shown as it is nearly completely placed within the sleeve on the pivot plate. In this position, once the weight of the sliding door is borne on the wheels, the pivot arm will rotate in a clockwise rotation until it strikes the abutting projection. The pivot plate will also rotate in clockwise rotation and will stop once the head 116 of the screw comes in contact with the side flange 118 of the bracket. In FIG. 8, the pivot arm and wheel assembly are depicted in dotted lines as the pivot arm strikes the abutting projection. In this position, the weight of the screen door causes the pivot arm and wheel assembly to move up to the upper most position shown by the dotted lines since the abutting projection is limited to its upper most position.

Referring now to FIG. 9, the head of the screw is shown extending much further out from its sleeve. In this position, the abutting projection is positioned much lower than it was positioned in FIG. 8. As a result, the pivot arm cannot move up as far as it did in FIG. 8. Referring again to FIG. 9, once the weight of the screen door is borne by the wheel assembly, the pivot arm moves upward to strike the abutting projection. Once the head of the screw hits the side flange of the bracket, the abutting projection stops. The pivot arm is also limited and the wheel assembly will remain in the position shown. As a result of moving the screw out from its sleeve, the wheel assembly will extend much further out from the frame once the weight of the screen door is placed on the bottom wheel assemblies. By adjusting the screw within the sleeve, the abutting projection can be moved vertically, thus contacting the pivot arm at different locations. In this fashion, the wheel assembly can be adjusted along a variety of outward positions from the mounting bracket. In this way, the "height" of the wheel is adjusted.

By utilizing this adjustment mechanism, one can either raise or lower the side of the door frame to permit the screen door to be aligned with the door jambs of its door opening. For instance, one of the bottom wheels may be extended out further from the frame than the other so that the screen door will be tilted a slight amount. By manipulating the two bottom wheel assemblies, one can tilt the screen door so that it aligns properly with the door jambs.

To enhance the low cost of the present invention the components can be made using machine punch presses. For instance, the mounting bracket, pivot plate and pivot arm can be easily manufactured using known punching and pressing techniques well-known in the art. The wheel housing can be made from a single piece of resilient material such as aluminum or steel by punching out the respective shape of the housing and then bending the metal using pressing machinery. The wheel can be made from plastic or metal and can be mounted to the housing via an axle or a rivet.

In using the present invention, the manufacturer cuts the desired size of the rails and stiles and places them on the mounting bracket as is shown in FIG. 1. The pivot arm is also made with a leading edge 120 shown in FIG. 1 which helps guide the pivot arm into the recess of the rail portion. The rail portion and stile portion are usually force fitted onto the mounting bracket and staked, preventing them from being moved during use.

The wheel assembly can be placed on the holding member by first placing the first slot 64 of the connecting wall 50 on the abutting projection 76 of the holding member. The wheel assembly can then be pivoted up so that the bridge portion 74 comes in contact with the guiding surface on the edge portion of the housing. The entire wheel assembly can then be simply pushed upward until the first locking fingers come in contact with the opening 56 of the holding member. Once the wheel assembly is snapped into place, it cannot be removed except by an outward force imparted on both of the two resilient side walls of the wheel housing.

In removing the wheel assembly from its holding member, one applies an outward force to the two opposing side walls to separate the fast locking fingers. This separation can be easily achieved by using the tool 105 which can be placed into holes located in the side walls. Once the tool is placed in the holes, the handles of the tool can be squeezed to impart the desired amount of force needed to separate the first locking fingers. Once the locking fingers are separated, the wheel assembly can easily be removed from the holding member. A new replacement wheel assembly can then be strapped back into the holding member.

In utilizing the adjustment mechanism, the upper and lower wheels should be first placed on their respective tracks. Depending upon the alignment of the screen door within its opening, the screen door might not have to be aligned with the door jambs of the opening. However, if adjustment is needed, the bottom wheels can be moved up or down by merely placing a screw driver through the opening in the stile to move the screw to the desired position within its sleeve. Both bottom wheel assemblies would probably have to be adjusted to obtain the desired tilt of the screen door to achieve a proper alignment.

Thus, there has been illustrated and described a unique and novel sliding door roller assembly that fulfills all of the objects and advantages set forth above. It should be noted that many changes, modifications, variations and other uses and applications will become apparent to those skilled in the art after considering this disclosure and the accompanying drawings. Therefore, any and all such changes, modifications, variations and other uses and applications which do not depart from the spirit and scope of the invention are deemed to be covered by the invention which is limited only by the following claims.

What is claimed is:

1. A sliding door roller apparatus comprising:

a mounting bracket; a holding member connected to said mounting bracket; and a wheel assembly removably mounted to said mounting bracket wherein said wheel assembly includes a wheel, an axle, and a resilient wheel housing having two opposing, resilient sidewalls each sidewall having an integral end portion extending toward the end portion of the other sidewall, and said end portions are biased toward each other to overlap each other and engage said holding member and are also resiliently separable to disengage said holding member.

2. The sliding door roller apparatus as defined in claim 1 wherein said holding member has an opening for receiving said end portions.

3. The sliding door roller apparatus as defined in claim 2 wherein each of said end portions includes a locking finger that extends towards and overlaps each other, said locking fingers being receivable within said opening on said holding member.

4. The sliding door roller apparatus as defined in claim 3 wherein each end portion includes a second locking finger spaced apart from said first-mentioned locking finger and extending towards and overlapping each other, the first and second fingers on the end portions collectively defining a receiving opening therebetween.

5. The sliding door roller apparatus as defined in claim 4 wherein said holding member includes a bridge portion located near said opening on said holding member that is positionable within said receiving opening defined by said first and second locking fingers.

6. The sliding door roller apparatus as defined in claim 5 including:

means for moving said end portions to move said first-mentioned locking fingers from their overlapping position.

7. The sliding door roller apparatus as defined in claim 6 wherein said moving means comprise:

a guiding surface integral with each of said first mentioned locking fingers, said guiding surface being adapted for sliding engagement with said bridge portion on said holding member.

8. The sliding door roller apparatus as defined in claim 7 wherein said wheel housing has a substantially U-shaped structure, said housing including a connecting wall integral with said side walls and disposed between said side walls.

9. The sliding door roller apparatus as defined in claim 8 wherein said holding member includes an abutting projection and said connecting wall includes a first slot formed therein for receiving said abutting projection.

10. The sliding door roller apparatus as defined in claim 9 wherein said holding member includes a recess forming a restraining surface, said connecting wall including an abutting slot with an abutment surface, said abutment surface being engageable with said restraining surface.

11. The sliding door roller apparatus as defined in claim 10 wherein each of said sidewalls has a hole defined therein and wherein said apparatus includes a tool, said tool being insertable in said holes on said sidewalls, whereby said tool is adapted to impart a force on said sidewalls to move said first mentioned locking fingers away from each other from their overlapping position.

12. The sliding door roller apparatus as defined in claim 1 including:

means for moving said wheel assembly on said mounting bracket.

13. The sliding door roller apparatus as defined in claim 12 further including means for limiting the amount of movement of said wheel assembly.

14. The sliding door roller apparatus as defined in claim 13 wherein said holding member is movable on said mounting bracket and said limiting means comprises:

means for abutting against said holding member, and means for moving said abutting means on said mounting bracket.

15. The sliding door roller apparatus as defined in claim 14 wherein said moving means comprise a limit member pivotally connected to said mounting bracket and said abutting means is a projection located on said limit member that abuts at least a portion of said holding member.

16. The sliding door rolling apparatus as defined in claim 15 wherein said holding member is a pivot arm having one end pivotally connected to said mounting bracket.

* * * * *